US009761987B2

(12) United States Patent
Ting et al.

(10) Patent No.: US 9,761,987 B2
(45) Date of Patent: Sep. 12, 2017

(54) ELECTRICAL CONNECTOR HAVING IMPROVED WATER-PROOF FUNCTION

(71) Applicant: FOXCONN INTERCONNECT TECHNOLOGY LIMITED, Grand Cayman (KY)

(72) Inventors: Chien-Jen Ting, New Taipei (TW); Zhi-Feng Wang, Kunshan (CN); Zu-Sheng Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/289,989

(22) Filed: Oct. 11, 2016

(65) Prior Publication Data

US 2017/0104291 A1 Apr. 13, 2017

(30) Foreign Application Priority Data

Oct. 12, 2015 (CN) ..... 2015 1 0653716

(51) Int. Cl.

| | |
|---|---|
| ***H01R 13/10*** | (2006.01) |
| ***H01R 13/52*** | (2006.01) |
| ***H01R 13/405*** | (2006.01) |
| ***H01R 43/20*** | (2006.01) |

(52) U.S. Cl.

CPC ..... *H01R 13/521* (2013.01); *H01R 13/405* (2013.01); *H01R 13/5213* (2013.01); *H01R 43/20* (2013.01)

(58) Field of Classification Search

CPC ... H01R 13/52; H01R 13/405; H01R 13/5213
USPC ..... 439/682
See application file for complete search history.

(56) References Cited

U.S. PATENT DOCUMENTS

| | | | | |
|---|---|---|---|---|
| 9,429,360 | B2 * | 8/2016 | Hsiao | F26B 3/28 |
| 9,627,806 | B2 * | 4/2017 | Wu | H01R 13/6271 |
| 2017/0104290 | A1 * | 4/2017 | Ting | H01R 13/504 |
| 2017/0104291 | A1 * | 4/2017 | Ting | H01R 13/405 |

FOREIGN PATENT DOCUMENTS

| | | |
|---|---|---|
| CN | 103367969 A | 10/2013 |
| TW | M449374 | 3/2013 |
| TW | M509996 | 10/2015 |

* cited by examiner

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

An electrical connector comprising an insulative housing defining a base which includes a first region and a first recess and a plurality of terminal grooves; and a terminal module which received in said first recess, including a plurality of terminals received in said terminal grooves respectively and a substrate insert-molded upon said terminals; wherein said first recess communicates with said first region and said terminal grooves are surrounded commonly by said first region and said first recess; wherein said electrical connector includes a main portion over-molded in said first region and said first recess.

17 Claims, 12 Drawing Sheets

ELECTRICAL CONNECTOR HAVING IMPROVED WATER-PROOF FUNCTION

BACKGROUND OF THE INVENTION

1. Field of the Invention

The present invention relates to an electrical connector having a water-proof function, and particularly to the electrical connector having a main portion over-molded between a terminal module and an insulative housing. This application relates to a copending application filed on the same day with the same applicant, having a title of "ELECTRICAL CONNECTOR AND THE METHOD OF MAKING THE SAME".

2. Description of Related Art

The Chinese Utility Patent No. CN103367969 discloses an electrical connector, comprising a metal shell, an insulating body fixed inside the metal shell, a conductive terminal fixed inside the insulating body, and an insulating shell fixed outside the metal shell. The conductive terminal comprises a contact part, a fixed part and a connecting part, wherein the contact part is exposed out of a tongue plate surface of the insulating body, and the connecting part extends out of the insulating body. The rear end of the insulating shell extends and forms a crimping part. The connecting part of the conductive terminal is fixedly held inside the crimping part, the surface of the connecting part is exposed out of the surface of the crimping part, and the connecting part of the conductive terminal is provided with a holding pin fixedly held in the crimping part of the insulating body. The electrical connector provided by the invention can ensure electrical contact between the conductive terminal and a butt-joint circuit board to be stable. Notably, one potential problem is regarding lacking waterproof function of the electrical connector, which is resulted in by an assembly clearance between the conductive terminal and the insulating body.

Hence, an electrical connector including an improved structure is necessary.

SUMMARY OF THE INVENTION

Accordingly, an object of the present invention is to provide an electrical connector overcoming the aforementioned shortcomings, and method of making the same with the improved structure.

To achieve the above object, provide an electrical connector comprising an insulative housing defining a base which includes a first region and a first recess and a plurality of terminal grooves; and a terminal module which received in said first recess, including a plurality of terminals received in said terminal grooves respectively and a substrate insert-molded upon said terminals; wherein said first recess communicates with said first region and said terminal grooves are surrounded commonly by said first region and said first recess; wherein said electrical connector includes a main portion over-molded in said first region and said first recess.

To achieve the above object, a method of making an electrical connector is disclosed, which comprising steps of: providing an insulative housing defining a base which includes a first region and a first recess and a plurality of terminal grooves; providing a terminal module which received in said first recess, including a plurality of terminals received in said terminal grooves respectively and a substrate insert-molded upon said terminals; wherein said first recess communicates with said first region and said terminal grooves are surrounded commonly by said first region and said first recess; and providing a main portion over-molded upon a bottom surface of said base, and with a sealing portion molded in said first recess and embedded between said terminal module and said base and with a welding portion molded in said first region.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-12 and particular to FIGS. 1-4, an electrical connector 100 comprising an insulative housing 1, a first reinforcer 8 and a second reinforcer 9 both covering the insulative housing 1 is disclosed.

Figure 1:
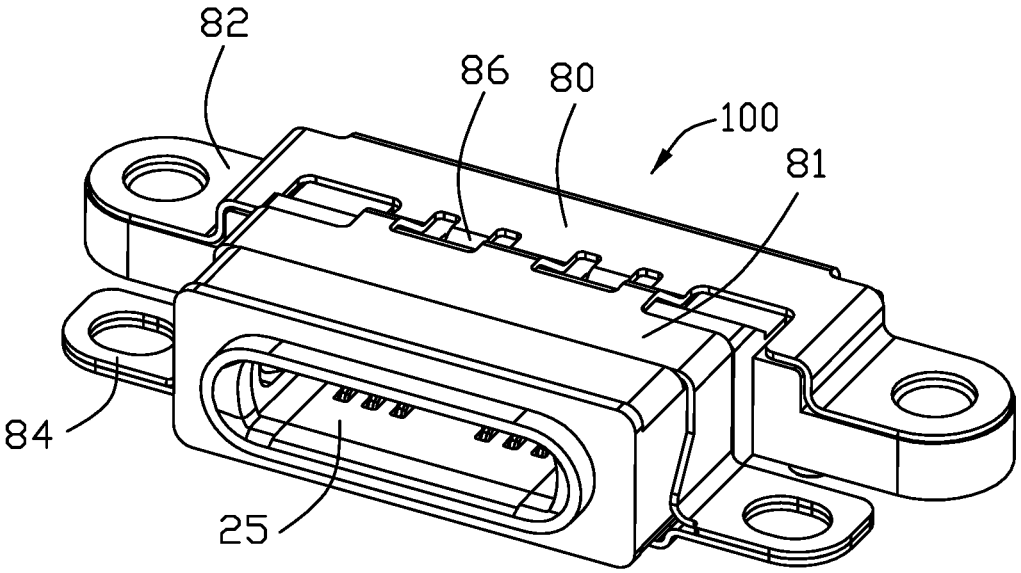
FIG. 1 is a perspective view of the electrical connector according to a preferred embodiment of the invention.
Figure 2:
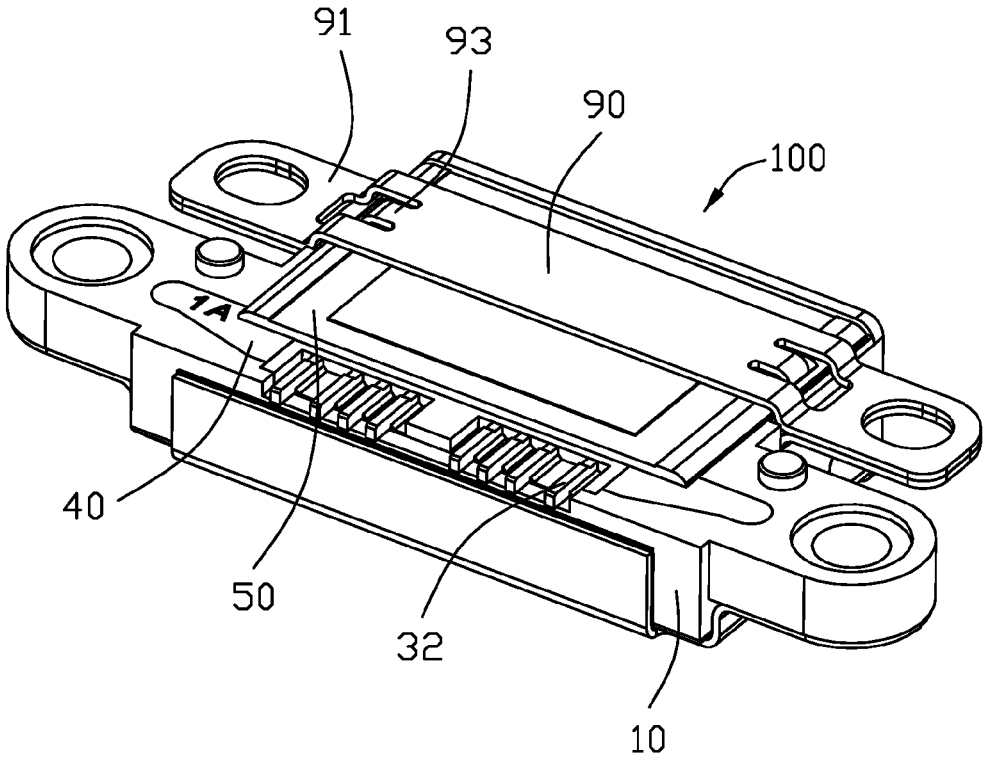
FIG. 2 is another view of the electrical connector in FIG. 1.
Figure 3:
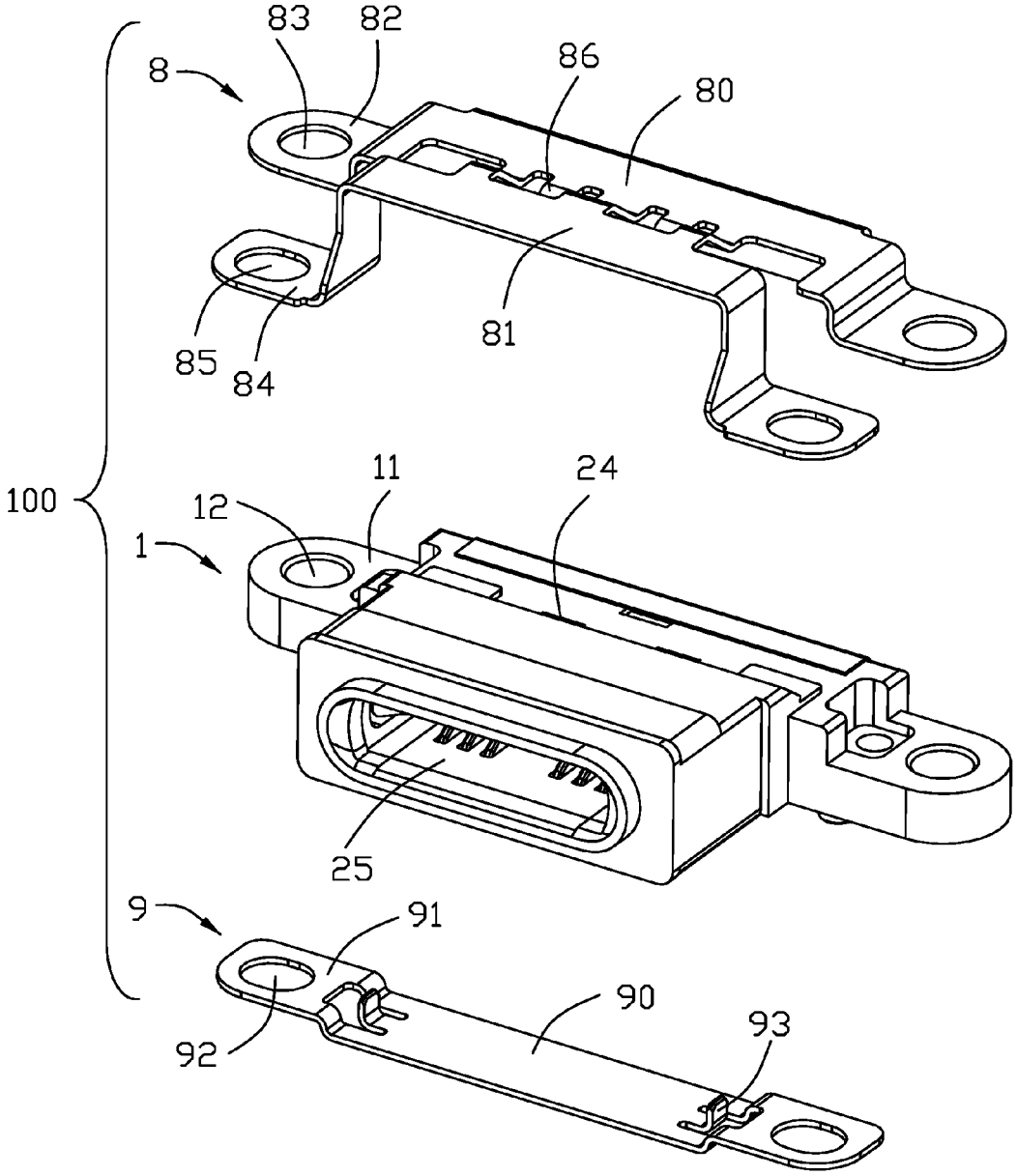
FIG. 3 is a partly exploded view of the electrical connector in FIG. 1.
Figure 4:
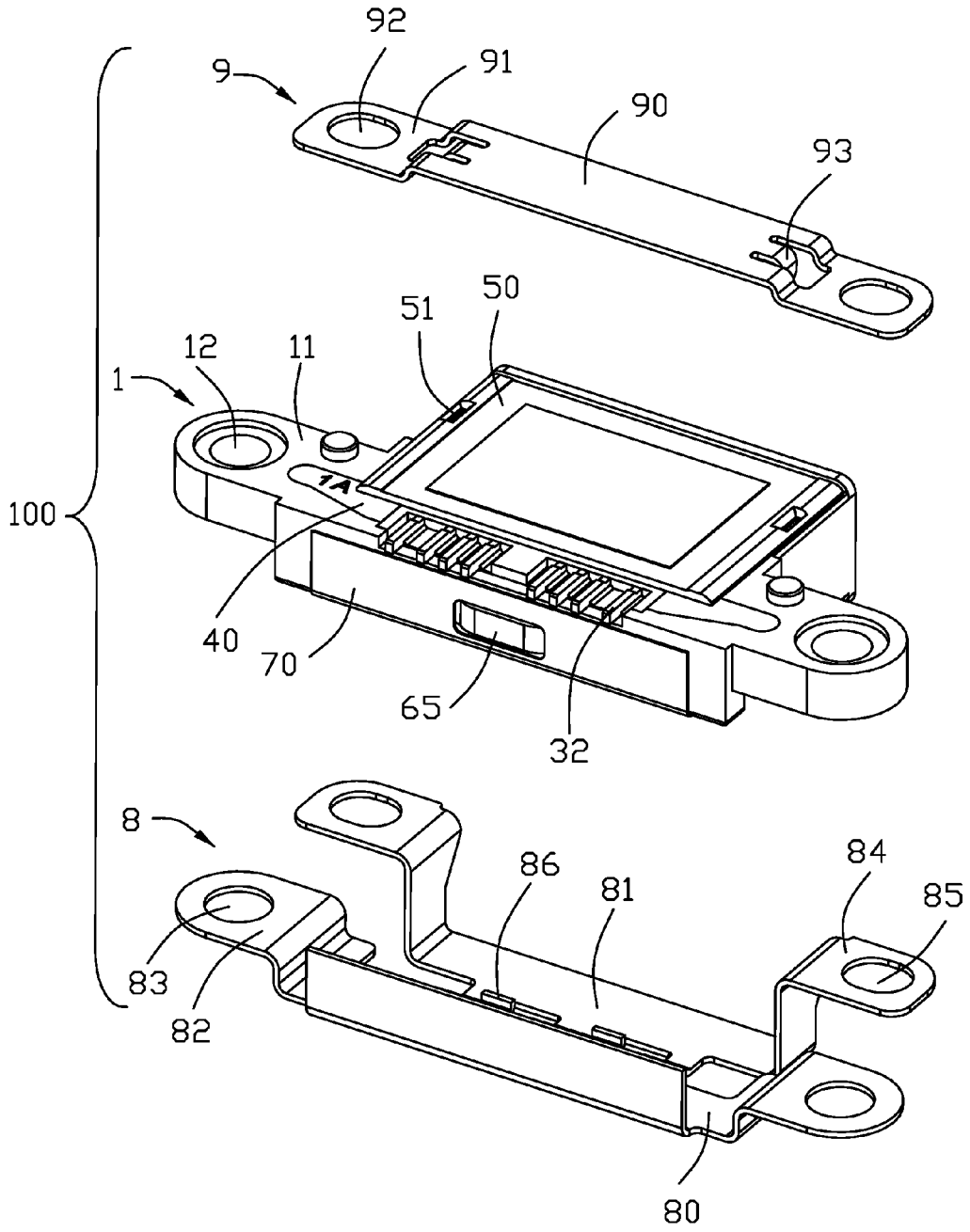
FIG. 4 is another view of the electrical connector in FIG. 3.
Figure 5:
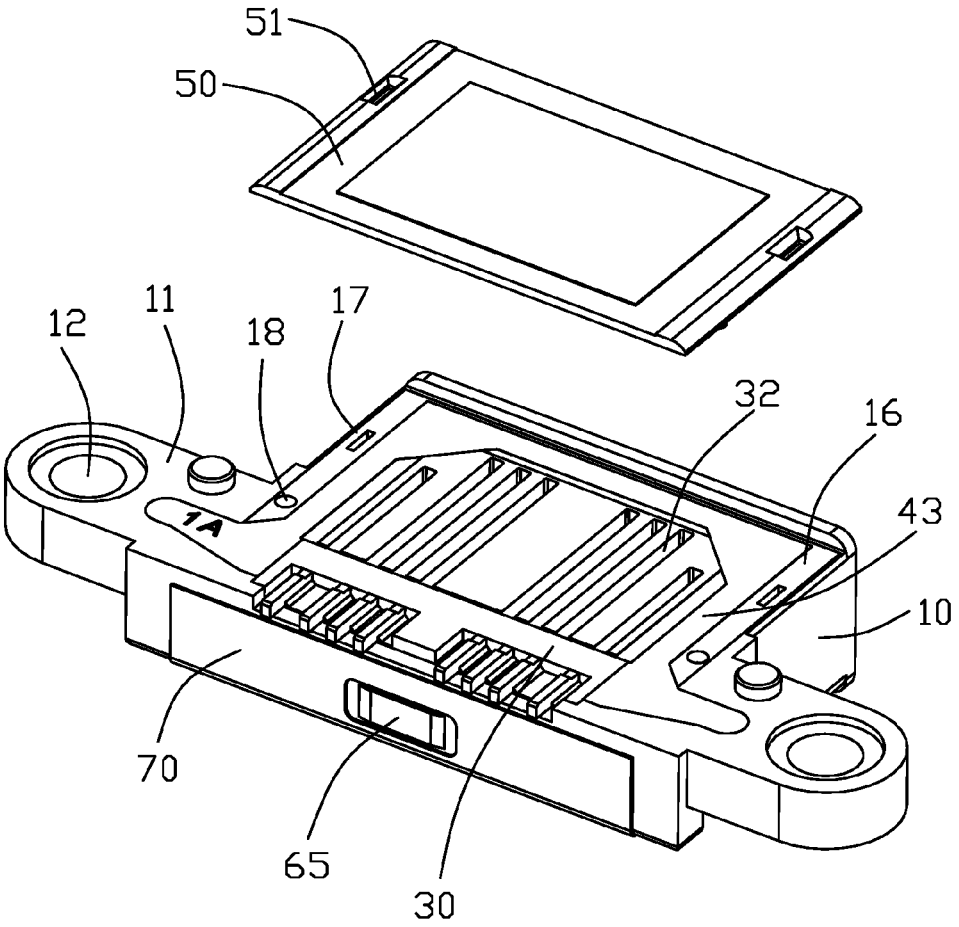
FIG. 5 is a partly exploded view of a part of the electrical connector in FIG. 4.
Figure 6:
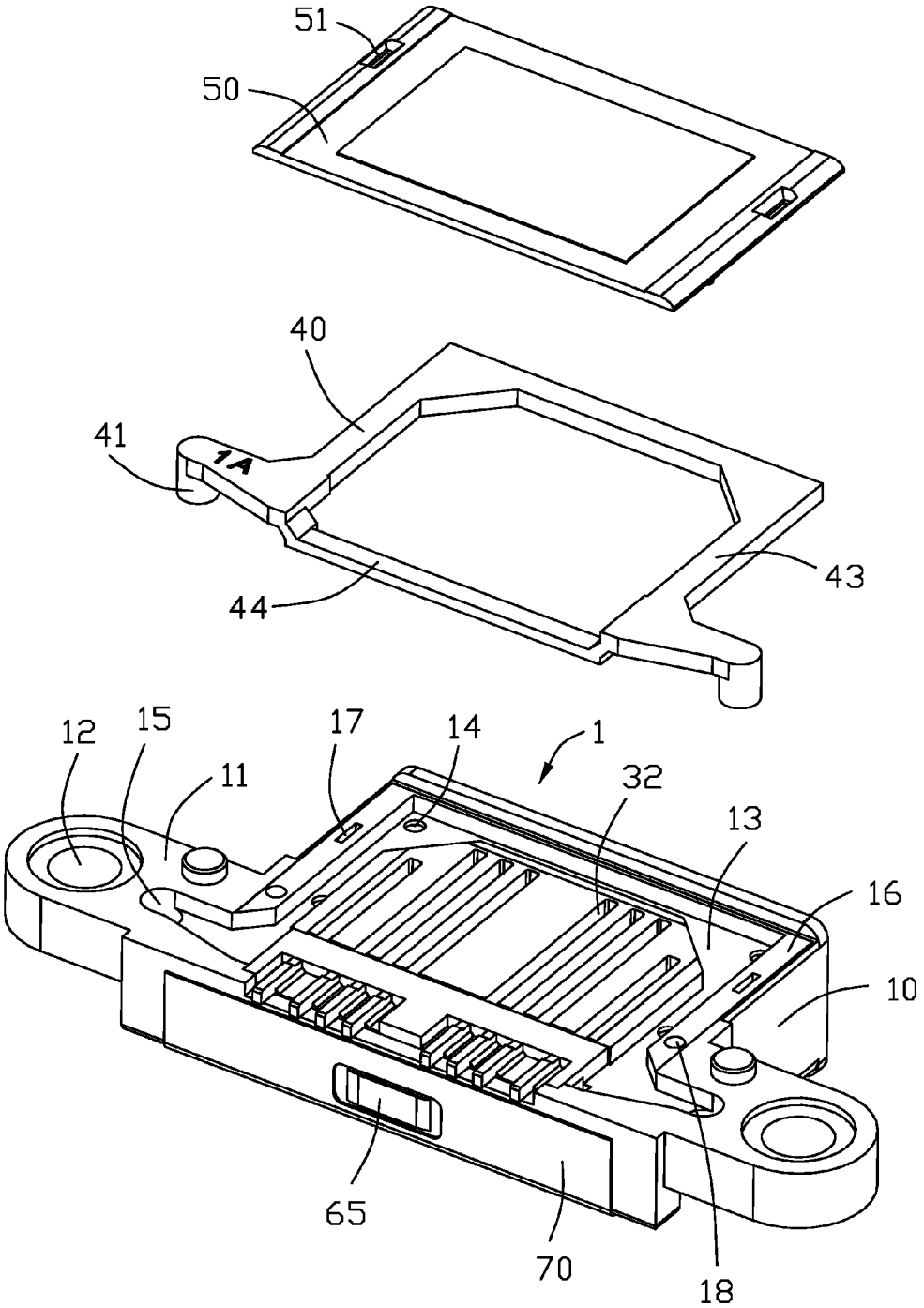
FIG. 6 is a further exploded view of the partial electrical connector in FIG. 5.
Figure 7:
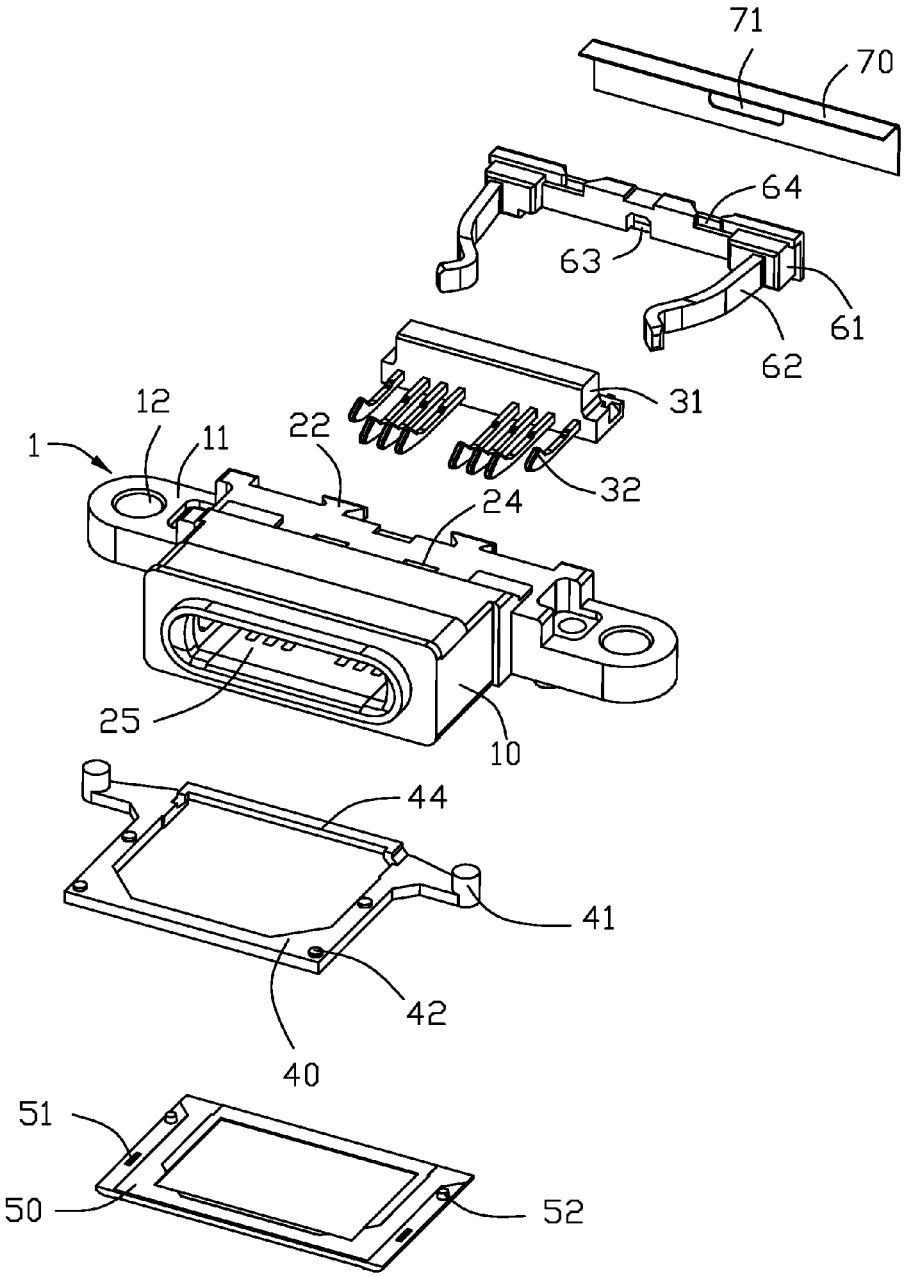
FIG. 7 is a further exploded view of the partial electrical connector in FIG. 6.
Figure 8:
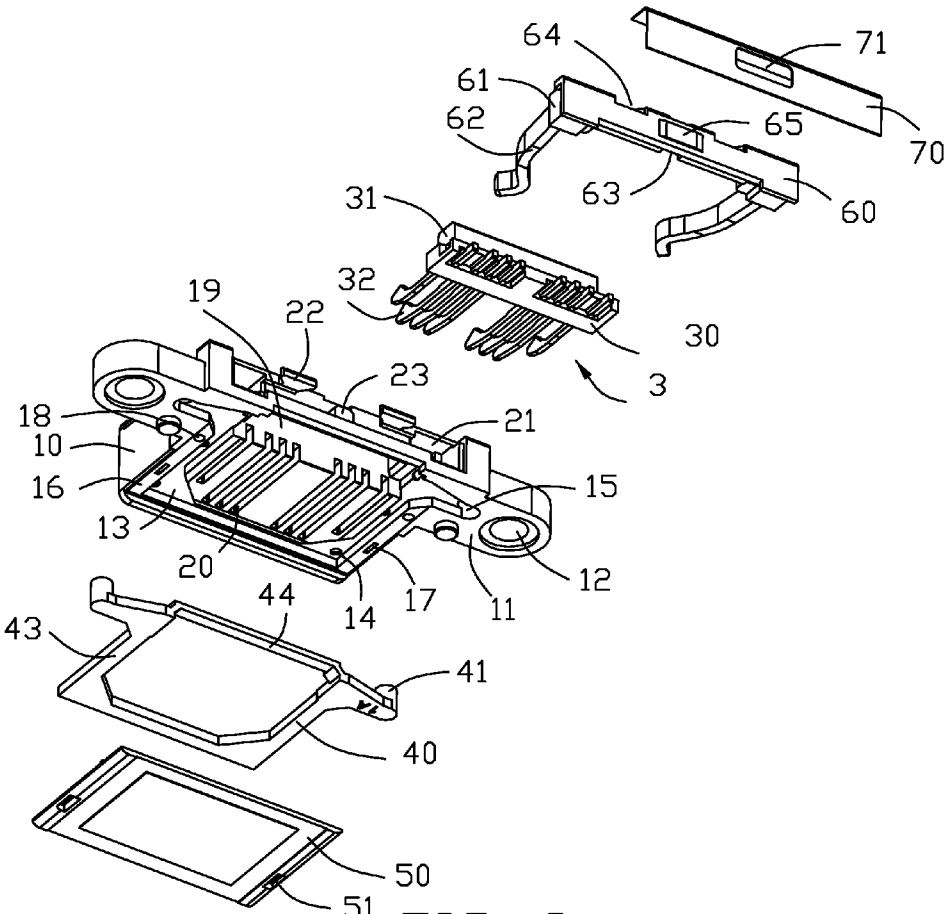
FIG. 8 is another view of the partial electrical connector in FIG. 7.
Figure 9:
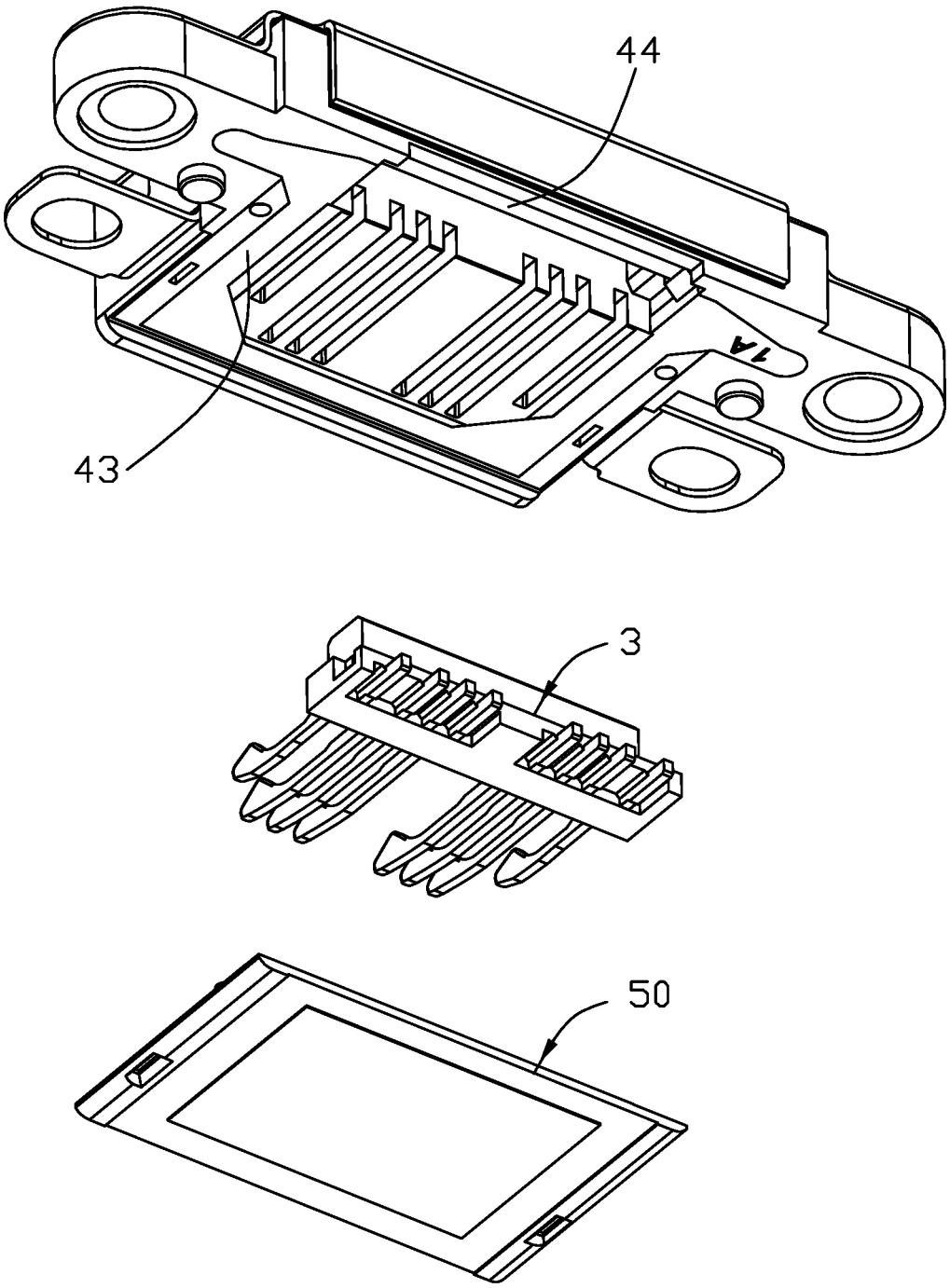
FIG. 9 is a perspective view to show how the main portion is received within the insulative housing.
Figure 10:
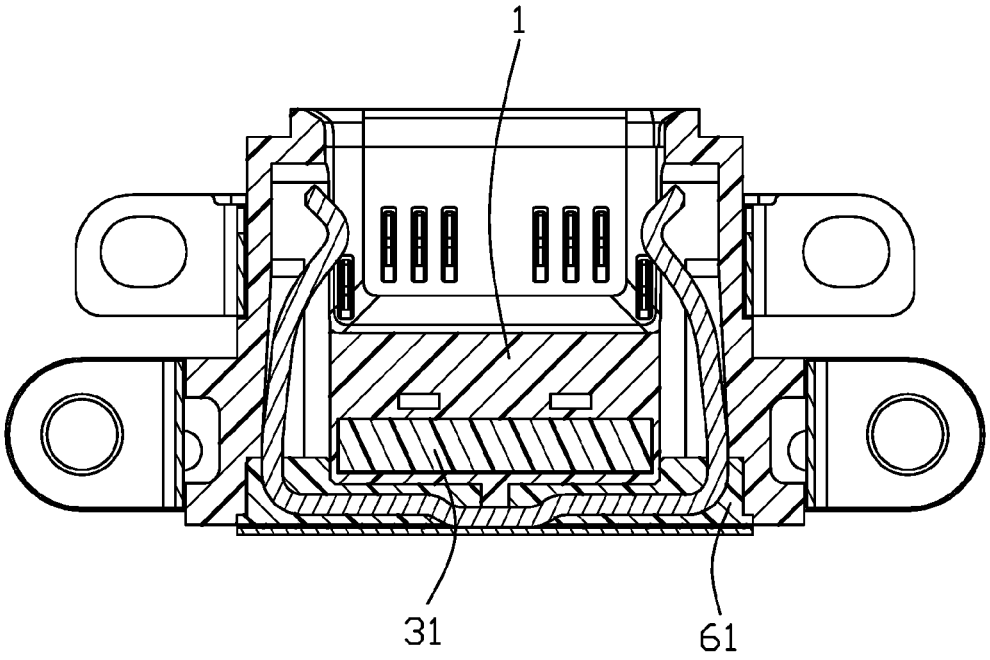
FIG. 10 is a horizontal cross-sectional view to show how the terminal module and the clipping member are assembled within the insulative housing.

Referring to FIGS. 6-8, the insulative housing 1 includes a base 10 and a pair of first extending parts 11 respectively extending from two opposite sides of the base 10. Each first extending part 11 defines a first positioning hole 12. A first region 13 formed by recessing a bottom surface of the insulative housing 1 and includes a first notch 14 positioned in the base 10 and a pair of concave parts 15 extending from the base 10 to the two first extending parts 11 respectively. There is a second region 16 disposed upon the bottom surface of the base 10 and below the first region 13 in a top-to-bottom direction, with a pair of first positioning depressions 17 and a pair of second notches 18 respectively symmetrically located at two opposite sides of the second region 16. In the preferred embodiment, the second region 16 surrounds the first region 13. The base 10 also defines a first recess 19 communicating with the first region 13, and a plurality of terminal grooves 20 going through the bottom surface thereof and surrounded commonly by the first recess 19 and the first region 13, and a second recess 21 and a first tuber 22 and a second tuber 23 all at a rear side of the base 10. The base 10 further defines a first locating slot 24 recessing a top surface thereof and a receiving space 25 recessing a mating surface thereof.

Referring to FIG. 8, the electrical connector 100 includes a terminal module 3 with a plurality of terminals 32 insert-molded in a substrate 30 and a third tuber 31 extending upward from the substrate 30. The terminal module 3 is installed in the first recess 19 of the base 10, and meanwhile the terminals 32 are received in the terminal grooves 20.

Referring to FIGS. 7-8, the electrical connector 100 further includes a substantially rectangular frame-shaped filler or main portion 40 corresponding to the first region 13 and the first recess 19, which includes a pair of convex parts 41 oppositely extending from two rear laterals thereof, and a welding portion 43 having a coplanar bottom surface, and a first embossment 42 protruding upwardly from the top surface of the welding portion 43, and a sealing portion 44 protruding upwardly from the welding portion 43 and located higher than the bottom surface of the welding portion 43. The main portion 40 is over-molded upon the first region 13 of the base 10 with the convex parts 41 thereof injected into the concave parts 15 of the base 10 and the first embossment 42 injected into the first notch 14 of the base 10. It is understood that the welding portion 43 is injection molded in the first region 13 and the sealing portion 44 is injection molded in the first recess 19 and embedded between the terminal module 3 and the insulative housing 1 in the top-to-bottom direction.

Referring to FIGS. 7-8, the electrical connector 100 contains a cover 50 with a pair of second positioning depressions 51 and a pair of fourth tubers 52 which are opposite in a left-to-right direction respectively. The cover 50 totally covers the welding portion 43 of the main portion 40 and meanwhile locks with the base 10, with that each second positioning depression 51 and each first positioning depressions 17 cooperate to form a positioning zone, and that the fourth tubers 52 are retained in the second notches 18 respectively.

Referring to FIG. 8, the electrical connector 100 contains a clipping member 60 including a fifth tuber 61 mating to the second recess 21 of the base 10 and a pair of clipping legs 62 extending respectively from two laterals of the fifth tuber 61 in the left-to-right direction and received in the receiving space 25 of the base 10 for an electrical engagement with a mating connector. The fifth tuber 61 further defines a third recess 63 for giving way to the second tuber 23 of the base 10 and a fourth recess 64 for giving way to the first tuber 22. Furtherly, there is a sixth tuber 65 disposed at a rear surface of the clipping member 60 in a front-to-rear direction.

Referring to FIG. 7, the electrical connector 100 contains a rear cover 70 covering the clipping member 60 and fixed with the base 10 on a rear surface of the base 10. The rear cover 70 defines a receiving cavity 71 to receive the sixth tuber 65 of the clipping member 60.

Referring to FIGS. 3-8, the first reinforcer 8 includes a first main body 80 and a second main body 81 engaging with each other, and a first tab 86 located therebetween and mating to the first locating slot 24 of the base 10. The first main body 80 includes a pair of second extending part 82 extending from two opposite laterals thereof in the left-to-right direction, each second extending part 82 having a second positioning hole 83 in line with the first positioning hole 12 of the first extending part 11 of the insulative housing 1 in the top-to-bottom direction. The second main body 81 includes a pair of third extending parts 84 each having a third positioning hole 85. The second reinforcer 9 includes a third main body 90. The third main body 90 contains a pair of fourth extending part 91 extending respectively from two opposite laterals thereof in the left-to-right direction, each of which having a fourth positioning hole 92 in line with the third positioning hole 85 of the first reinforcer 8 in the top-to-bottom direction. Furtherly, the third main body 90 includes a pair of second tabs 93 at two opposite laterals thereof in the left-to-right direction so as to be inserted into the positioning zone formed by the second positioning depression 51 of the cover 50 and the first positioning depression 17 of the base 10 for a fixation.

When assembling, insert the clipping member 60 into the receiving space 25 of the base 10 in a condition that the fifth tuber 61 fills the second recess 21 of the base 10, and the clipping legs 62 are received in the receiving space 25 for an electrical engagement with the mating connector, and the third recess 63 receives the second tuber 23 while the fourth recess 64 receives the first tuber 22 of the base 10. When assembling, make the rear cover 70 cover the rear surface of the clipping member 60 and fix with the base 10 on the rear surface of the base 10 in a condition that the receiving cavity 71 of the rear cover 70 receives the sixth tuber 65 of the clipping member 60. When assembling, the insulative housing 1 is covered by the first reinforcer 8 and the second reinforcer 9, wherein the first reinforcer 8 is assembled onto the insulative housing 1 from up to down so as to make the first tab 86 of the first reinforcer 8 fix with the first locating slot 24 of the insulative housing 1, with that the second positioning hole 83 of the first reinforcer 8 aligns to the first positioning hole 12 of the insulative housing 1 in the top-to-bottom direction, and wherein the second reinforcer 9 is assembled onto the insulative housing 1 in a reverse direction so as to insert the second tab 93 into the positioning zone where the second positioning depression 51 of the cover 50 and the first positioning depression 17 of the base 10 are aligned in the top-to-bottom direction, and meanwhile the fourth positioning hole 92 of the second reinforcer 9 aligns to the third positioning hole 85 of the first reinforcer 8 in the top-to-bottom direction. When assembling, the terminal module 3 is assembled into the first recess 19 of the base 10 from down to up so that the terminals 32 are inserted into the terminal grooves 20 of the base 10, and after the assembling of the terminal module 3, the bottom surface of the substrate 30 of the terminal module 3 is exposed upon the insulative housing 1, and normally the first recess 19 includes a gap/assembly clearance formed between the terminal module 3 and the base 10 of the insulative housing 1, which is filled by the sealing portion 44 of the main portion 40. The main portion 40 is formed in the following step.

Figure 11:
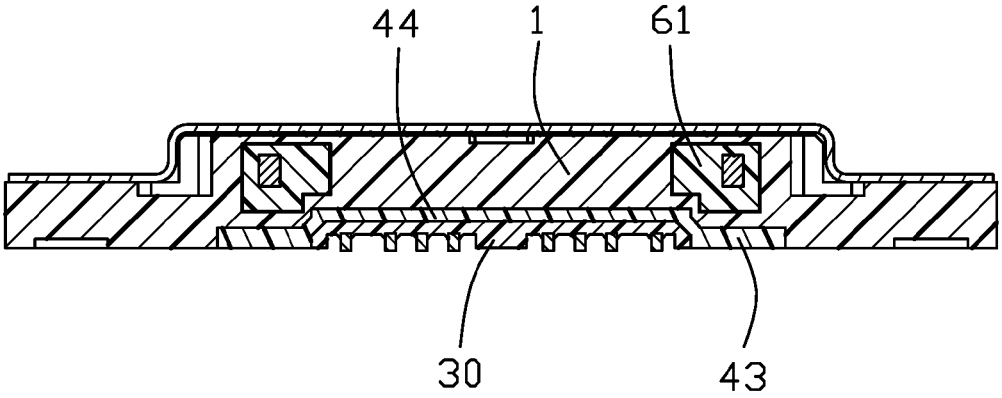
FIG. 11 is a vertical cross-sectional view, along a transverse plane, to show the structural relationship among the insulative housing, the terminal module and the main portion around a rear end of the whole connector.
Figure 12:
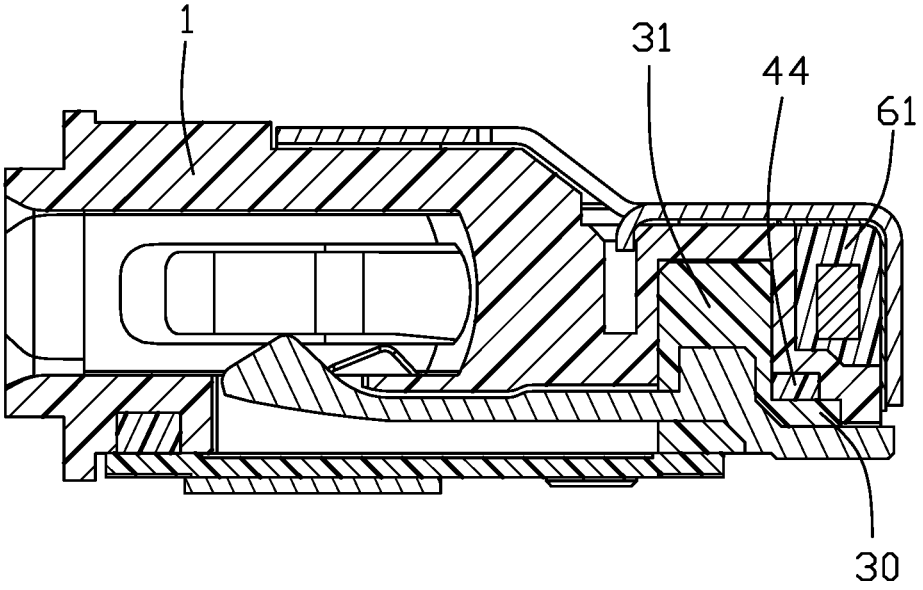
FIG. 12 is another vertical cross-sectional view, along a front-to-back plane, to show the relationship among the insulative housing, the main portion and the terminal module.

It is to be noted that the main portion 40 in the preferred embodiment of the present invention is injection molded in the first region 13 and around the terminal module 3 after the terminal module 3 is assembled, and at that time the convex parts 41 of the main portion 40 are formed in the concave part 15 of the first region 13, and the first embossment 42 of the main portion 40 is formed in the first notch 14 of the base 10, and the welding portion 43 is injection molded on the first region 13, and the sealing portion 44 is injection molded and embedded between the terminal module 3 and the insulative housing 1. Wherein the bottom surface of the substrate 30 of the terminal module 3 is coplanar with the bottom surface of the welding portion 43 to form a coplanar rectangular loop preparing for a following dot welding process. As all said above, there is only one outward surface left and necessarily needed to be sealed for the terminals 32, which is the bottom surface of the insulative housing 1. Notably, the traditional connector may have the terminal module tightly inserted into the insulative housing for assembling. Anyhow, disregarding how fine the manufacturing precision/tolerance is, there are still gaps between the terminal module and the insulative housing along the interface region therebetween. In the instant invention, a significant cavity/recess is formed between the interface region(s) of the insulative housing 1 and the terminal module 3, either in a horizontal/transveres direction or in a vertical direction (as shown in FIG. 11), and is successively fully filled with the main portion 40 which is injection-molded after the terminal module 3 is assembled upon the insulative housing 1 so as to not only reliably retain the terminal module 3 to the insulative housing 1 but also efficiently seal any possible tiny gaps between the terminal module 3 and the insulative housing 1 for perfect waterproof consideration. Another feature of the invention is to have the terminal module 3 assembled into the housing from a (bottom) side of the housing in a vertical direction and have the cover 50 shield such an opened side for sealing consideration. It efficiently eases the whole manufacturing process.

Whereafter, the cover 50 is assembled onto the main portion 40 from down to up and retained by the base 10 at the time the second positioning depressions 51 of the cover 50 cooperate with the first positioning depressions 17 of the base 10 by aligning to each other in the top-to-bottom direction to form a positioning zone, and the fourth tubers 52 of the cover 50 are inserted into the second notches 18 of the base 10. Immediately following, the cover 50 is dot welded on the coplanar bottom surfaces of both the welding portion 43 of the main portion 40 and the substrate 30 of the terminal module 3 which are exposed upon the bottom surface of the insulative housing 1 via a laser technology, by which the cover 50 attaches tightly onto the insulative housing 1 so that the bottom surface of the insulative housing 1 is sealed by the cover 50. As a result, the cover 50 is integrally formed with the insulative housing 1 and the main portion 40 at the first region 13 for an efficient sealing which is inductive to a water-proof function.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising an insulative housing defining a base which includes a first region and a first recess and a plurality of terminal grooves; and a terminal nodule which received in said first recess, including a plurality of terminals received in said terminal grooves respectively and a substrate insert-molded upon said terminals; wherein said first recess communicates with said first region and said terminal grooves are surrounded commonly by said first region and said first recess; wherein said electrical connector includes a main portion over-molded in said first region and said first recess; wherein said first region is formed by recessing a bottom surface of insulative housing and includes a first notch and a pair of concave parts positioned in the base, and said main portion forms in said first region with a pair of convex parts injected into said concave parts and a first embossment injected into said first notch.

2. The electrical connector as claimed in claim 1, wherein said main portion includes a welding portion having a coplanar bottom surface and molded in said first region, and a sealing portion molded in said first recess and embedded between said terminal module and said base.

3. The electrical connector as claimed in claim 2, wherein said electrical connector further includes a cover which is assembled from down to up onto said main portion, whereafter said cover is dot welded on a bottom surface of said main portion via a laser technology.

4. The electrical connector as claimed in claim 3, wherein said substrate of said terminal module has a bottom surface which is coplanar with the bottom surface of said welding portion, and said cover is dot welded on the bottom surfaces of both said welding portion of said main portion and said substrate of said terminal module which are respectively exposed upon the bottom surface of the insulative housing.

5. The electrical connector as claimed in claim 1, wherein there is a second region surrounding said first region and protruding downwardly with regard to the bottom surface of said first region, with a pair of first positioning depressions and a pair of second notches respectively symmetrically located at two opposite sides of said second region, and said cover totally covers said welding portion of said main portion, and meanwhile locks with the base in a way that said cover defines a pair of second positioning depressions respectively aligning to said first positioning depressions in a up-to-down direction to cooperatively form a positioning zone, and a pair of fourth tubers respectively retained in the second notches.

6. The electrical connector as claimed in claim 1, wherein said electrical connector further contains a clipping member assembled to the base and adjacent to said first recess, and a rear cover covering said clipping member from rear to front and fixed with said base on a rear surface of said base.

7. A method of making an electrical connector comprising: providing an insulative housing defining a base which includes a first region and a first recess and a plurality of terminal grooves; providing a terminal module including a plurality of terminals and a substrate insert-molded upon said terminals, assembling said terminal module onto said insulative housing with substrate received in said first recess and terminals protruding into said terminal grooves respectively; wherein said first recess communicates with said first region and said terminal grooves are surrounded commonly by said first region and said first recess; and providing a main portion over-molded upon a bottom surface of said base, and said main portion forming a sealing portion molded in said first recess and embedded between said terminal module and said base, and a welding portion molded in said first region; wherein said first region is formed by recessing a bottom surface of insulative housing and includes a first notch and a pair of concave parts positioned in the base, and said main portion forms in said first region with a pair of convex parts injected into said concave parts and a first embossment injected into said first notch.

8. The method as claimed in claim 7, wherein further providing a cover assembled from down to up onto said main portion; and dot welding said cover on a bottom surface of said main portion via a laser technology.

9. The method as claimed in claim 8, wherein further providing a clipping member assembled to the base and adjacent to said first recess; and providing a rear cover covering said clipping member from rear to front and fixed with said base on a rear surface of said base.

10. An electrical connector comprising: an insulative housing defining a receiving space around a front side of the housing for mating with a complementary connector, and a recess around arear side of the housing; a terminal module including a plurality of terminals insert-molded within an insulative substrate, said insulative substrate being received within the receiving recess and the terminals extending into the receiving space; viewed along, a front-to-back direction, gaps being formed between the substrate and the housing in both a transverse direction and a vertical direction perpendicular to each other and both perpendicular to said front-to-back direction; and an insulative main filler filling the gaps; wherein the terminal module is assembled upon one side of the housing, and said filler includes a welding portion which is exposed upon said side and on which a cover is welded to shield said side; herein said filler further includes a sealing portion sandwiched between the substrate of the terminal module and the housing and located above said welding portion in the vertical direction.

11. The electrical connector as claimed in claim 10, wherein said terminal module is assembled from one side into the housing, and a cover is welded upon the filler to shield said side.

12. The electrical connector as claimed in claim 11, wherein said cover is further soldered upon the substrate of the terminal module.

13. The electrical connector as claimed in claim 11, wherein said housing forms a plurality of terminal grooves in said side to allow said terminal module to be assembled into the housing from said side.

14. The electrical connector as claimed in claim 13, wherein said side is a bottom side of the housing perpendicular to both said front side and the rear side.

15. The electrical connector as claimed in claim 14, wherein said terminal module is assembled to the housing in the vertical direction.

16. The electrical connector as claimed in claim 10, further including a clipping member assembled to the housing upon the rear side with clipping legs extending forwardly into the receiving space, wherein said clipping member is isolated from the insulative substrate of the terminal module by the insulative housing in both said front-to-back direction and said vertical direction.

17. The electrical connector as claimed in claim 10, wherein the housing forms a recessed region to receive in said recessed region.

* * * * *